United States Patent [19]

Garcia

[11] 3,959,634

[45] May 25, 1976

[54] OPERATION COUNTER FOR CABLE ACTUATED MECHANICAL CLUTCHES

[76] Inventor: Uville A. Garcia, 1500 SW. 67th Ave., Miami, Fla. 33144

[22] Filed: Feb. 21, 1975

[21] Appl. No.: 551,524

Related U.S. Application Data

[63] Continuation-in-part of Ser. No. 505,198, Sept. 12, 1974.

[52] U.S. Cl. ..... 235/92 PD; 235/92 B; 235/92 MP; 235/92 R

[51] Int. Cl.[2] ..... G06M 3/12

[58] Field of Search ..... 235/92 PD, 92 C, 92 B, 235/92 TC, 92 MP, 92 FP; 200/61.85

[56] References Cited

UNITED STATES PATENTS 2,426,287 8/1947 Strout ..... 235/92 PD

*Primary Examiner*—Joseph M. Thesz

[57] ABSTRACT

A mechanical operation counter is independently connected by a slide wire cable to one arm of the control lever of a lever-actuated power take-off clutch, the other end of which lever normally interconnects through a slide wire cable to a push-pull knob for manually controlling the operation of the clutch. The independently controlled operation counter comprises an electrical switching device including a pair of spaced electrical contact members and a slide bar fixed with respect to the remote end of the operation counter cable slide wire and having a spring pressed shorting bar adapted to close-circuit the switch contact members each time the associated control wire is pushed in or out with respect to its outer sleeve during movement of the power take-off clutch lever as controlled by its associated manually controlled slide wire cable. The electrical switch comprising the normally opened-circuit switch contact members is connected in series with an engergization circuit for an electromechanical counter serving to record the number of individual operations being performed upon the lever actuated take-off clutch as controlled by manual actuation of its associated control cable slide wire.

9 Claims, 7 Drawing Figures

OPERATION COUNTER FOR CABLE ACTUATED MECHANICAL CLUTCHES

This application is a continuation in part of my application Ser. No. 505,198 filed Sept. 12, 1974 and entitled OPERATION COUNTER FOR CABLE ACTUATED MECHANICAL CLUTCHES.

The invention relates to automatic mechanical operation counters and is directed particularly to a novel and improved operation counter for lever-controlled mechanical devices such as power take-off clutches of the type associated with wrecker hoisting winches.

The power take-off mechanism associated with four-wheel drive vehicles is ordinarily controlled by a power take-off clutch lever remotely actuated by the operator through use of a flexible slide-wire cable extending between the take-off clutch at one end of the cable and a manual push-pull knob at the other end of the cable slide-wire and conveniently mounted in the cab of the vehicle for control by the operator. In the case of wrecker vehicles, the power take-off is mechanically connected with a winch or the like lifting and lowering device for the raising and lowering of a disabled vehicle to be transported. The present invention has for its principal object the provision of an operation counter for such cable-actuated mechanical clutches to enable a wrecker vehicle fleet operator keeping an accurate tally of the number of clutch operations undertaken by the operator or driver of a wrecker during the course of a business day. In this manner, the wrecker fleet operator can determine if unauthorized wrecker service has been rendered by any particular driver of a fleet vehicle during the course of a business day. Such unauthorized and independent wrecker use results in economic loss to the owner not only as to the charges made for such unauthorized service, but also for loss of wrecker time available for use in legitimate and authorized wrecker service.

It is a more particular object of this invention to provide an operation counter of the character described that is independently connectable to the power take-off clutch lever by means of its own flexible slide wire cable to permit ready installation at any desired location within the body or chassis of an associated vehicle, which location preferably would be substantially inaccessible to the wrecker driver to minimize any possibility of tampering therewith.

Yet another object of the invention is to provide an operation counter with independent connection means to the control lever of a power take-off clutch lever, and including electrical switch-actuated means for registering on an electromechanical counter the number of operations being performed on the power take-off clutch by its independent manually controlled slide wire cable.

A more particular object of the invention is to provide an electrical switching device of the character described including a body structure having a pair of spaced, normally opened-circuited electrical switch contacts, and means carried by the independent cable slide wire associated with the operation counter for cross-connecting the electrical switch contacts for energizing an electro-mechanical counter to count each time the control lever of the power take-off clutch is actuated by manually pulling or pushing upon its clutch actuating control cable slide wire knob.

Another object of the invention is to provide an electrical switching device of the character described wherein the body structure of the operation counter slide switch assembly comprises identically formed half housing members which can readily be formed of a suitable synthetic plastic material by simple injection molding techniques, for economy of manufacture.

Yet another object of the invention is to provide an operation counter of the above nature including adjustable attachment means for extending the inner end of the control lever of a power take-off clutch to permit connection of an independent flexible control wire thereto for actuation of the electrical switching device.

Other objects, features and advantages of the invention will be apparent from the following description when read with reference to the accompanying drawings. In the drawings, wherein like reference numerals denote corresponding parts throughout the several views.

Figure 6:
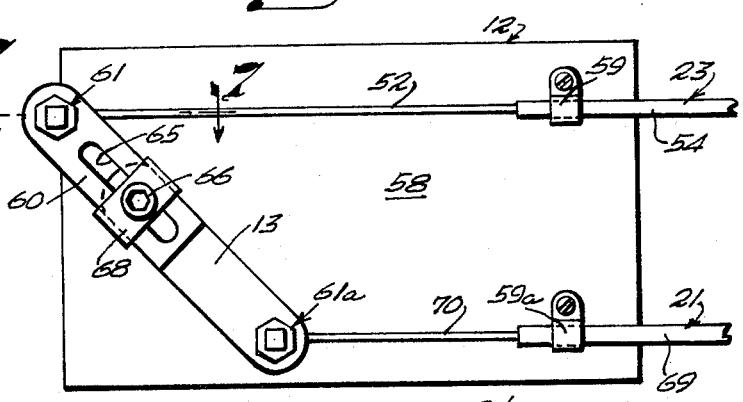
Figure 5:
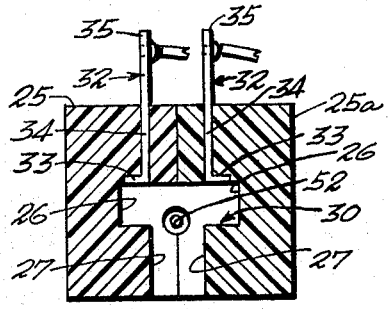
FIG. 5 is a transverse cross-sectional view of the cable actuated switch mechanism, taken along the line 5—5 of FIG. 2 in the direction of the arrows.
Figure 7:
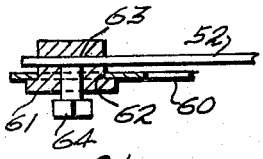

FIG. 6 is an elevational view of the outside of the power take-off mechanism housing, illustrating it actuating lever and the lever arm extension mechanism comprising the invention; and FIG. 7 is a horizontal cross-sectional view taken along the line 7—7 of FIG. 6, in the direction of the arrows, and illustrating details of the mechanical connection between the ends of the slide wire cables and the power take-off clutch control lever.

Figure 1:
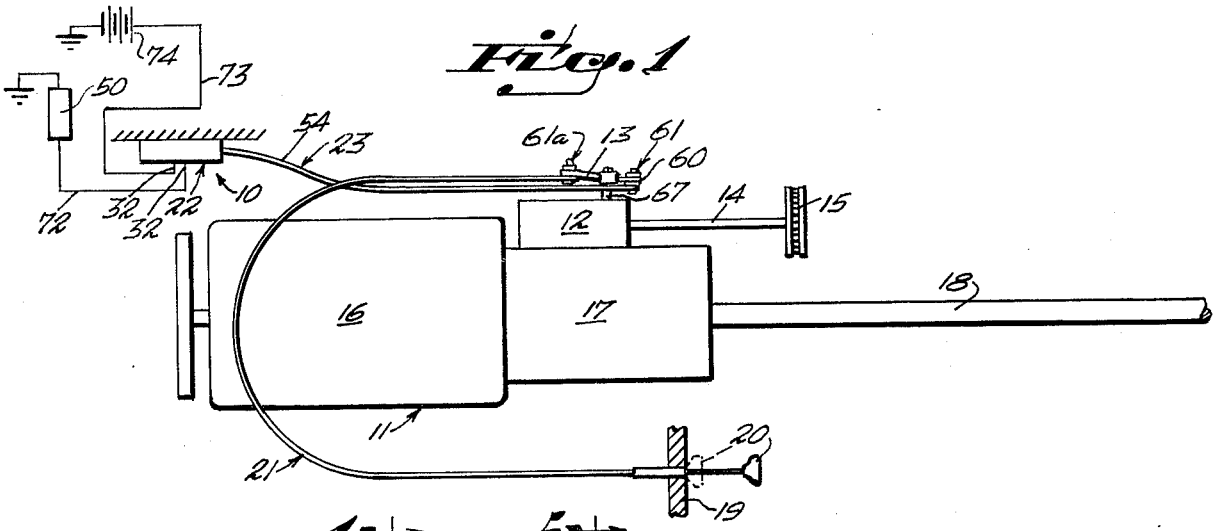
FIG. 1 illustrates, schematically, an operation counter embodying the invention, shown in association with the power take-off clutch mechanism of a wrecker vehicle for counting, lifting and lowering operations of the winch mechanism.

Referring in detail to the drawings, reference numeral 10 designates, generally, an operation counter embodying the invention, the same being illustrated for use in association with a wrecker vehicle engine 11 having a power take-off gear box 12 controlled by a power take-off drive shaft 14 carrying a take-off drive gear 15 powering a winch or the like mechanism (not illustrated) for lifting and lowering a disabled vehicle to be transported. FIG. 1 further illustrates, by way of example and in block form, the vehicle motor 16, main clutch and transmission gear box 17 and drive shaft 18 for powering the rear wheels of a typical wrecker to which the present invention is applied. Reference numeral 19 in FIG. 1 designates a portion of the dashboard or instrument panel of the vehicle in which the actuating knob 20 is installed for take-off clutch operation through a flexible slide cable 21 in the manner hereinbelow more particularly described.

Figure 2:
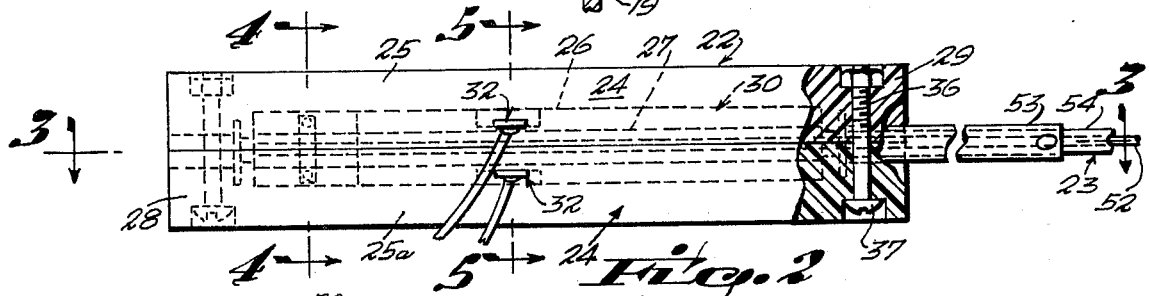
FIG. 2 is a plan view of the cable actuated switch mechanism comprising the invention.
Figure 3:
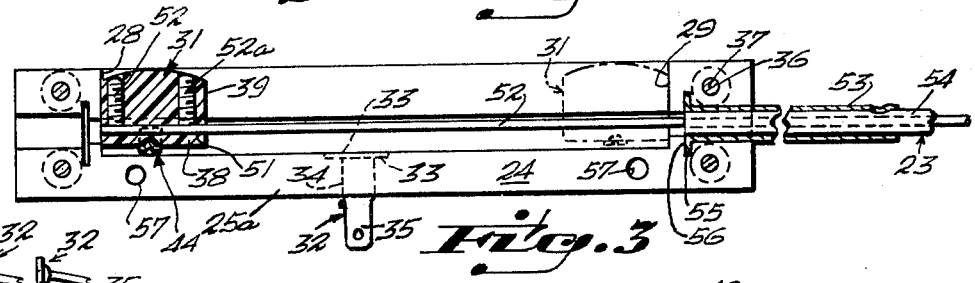
FIG. 3 is a longitudinal cross-sectional view of the cable actuated switch mechanism, taken along the line 3—3 of FIG. 2 in the direction of the arrows.
Figure 4:
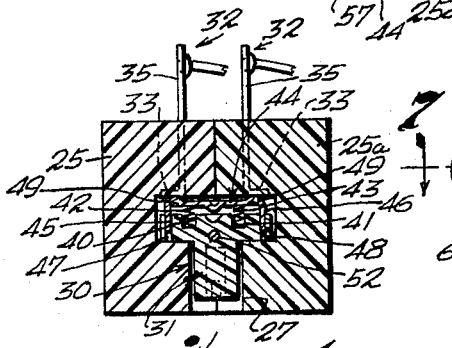
FIG. 4 is a transverse cross-sectional view of the cable actuated switch mechanism, taken along the line 4—4 of FIG. 2 in the direction of the arrows.

The operation counter 10 embodying the invention comprises an electrical switching device 22 remotely interconnected with the power take-off clutch lever 13 by an independent flexible slide wire cable 23, as is herein below more particularly described. As best illustrated in FIGS. 2 through 4, the electrical switching device 22 comprises an elongated housing structure 24, which is approximately square in cross-sectional shape. The housing structure 24 is fabricated of a pair of identical half housing members 25, 25*a*, which preferably will be injection molded of a tough, non-electrically conductive synthetic plastic material.

Each of the half housing members 25, 25*a* is formed along one side with a rectangular recess 26 which merges at one side with a comparatively shallow rectangular recess 27 opening into the outside of its respective half housing member. As best illustrated in FIGS. 2 and 3, the rectangular recesses 26, 27 extend somewhat short of each end of their respective half housing members, so as to define interior end walls 28, 29 in the assembled housing structure 24 (see FIG. 2).

When the identical half housing members 25, 25*a* are assembled in a face-to-face interfitting relation, as illustrated, their respective recesses 26 and 27 together define a T-shaped guidance slot 30 slidingly received in which is a slide bar 31 of substantially conforming T-shape configuration, for the purpose hereinafter more particularly described.

As best illustrated in FIGS. 3 and 4, each of the half housing members 25, 25*a* has molded therein, centrally along its length, an electrical contact member 32 having an interior contact surface portion 33 flush with the inner or bottom wall transverse surface of its respective rectangular recess 26, and a sidewardly, outwardly-bent portion 34 terminating in an exterior connector lug portion 35. As is hereinbelow more particularly described, the electrical contact members 32, 32 comprise fixed contact elements of a normally open-circuit electrical switch adapted to be closed-circuited by passage thereover of an electrical shorting bar or brush carried by the slide bar 31.

The ends of the half housing members 25, 25*a* are formed with identical, symetrically arranged, transversely extending, counter-sunk openings 36 for the reception and through passage of machine bolts 37 for retaining said half housing members in assembled relation.

As best illustrated in FIGS. 3 and 4, the slide bar 31, which will also preferably be injection molded of a tough, substantially rigid synthetic plastic material, comprises a head portion 38 and a centrally outwardly extending web portion 39. The head portion 38 is provided with a pair of aligned, transversely-spaced blind openings 40, 41 received within and extending outwardly of which are a pair of helical compression springs 42, 43, respectively. Transversely disposed in straddling relation above the compression springs 42, 43 is an inverted, U-shaped metallic brush contact member 44, the opposed, downturned end portions 45, 46 of which are slidingly received in opposed shallow recesses 47, 48, respectively, in the slide member head portion 38.

As illustrated in FIG. 4, the head portion 38 of the slide bar 31 is of such size, and the compression springs 42, 43 are such length, as to press the brush contact member 44 resiliently against the inner transverse wall of the T-shape guidance slot 30 of the housing structure 24.

As further illustrated in FIG. 4, the brush contact member 44 is stamped near each end with protrusions 49, 49 spaced by approximately the same distance as the spacing between the interior contact surface portions 33 of the electrical contact members 32. It will thus be understood that as the slide bar 31 moves past the contact surface portions 33, 33 in one direction or the other, its brush contact member 44 will electrically interconnect said electrical contact members momentarily to effect close-circuiting of the electrical switch comprising electrical contact members 32, 32. As hereinbelow more particularly described, such close-circuiting of the switch momentarily closes the electrical energization circuit of an operation counter 50 to record a power takeoff clutch operation.

Cable controlled means is provided for moving the slide bar 31 back and forth within its elongated housing structure 24 upon manual operation of the power take-off clutch actuating knob 20 by the operator of the wrecker vehicle hoist mechanism. To this end, the slide bar 31 is formed with a longitudinal opening 51 through which one end of a control wire 52 of the independent flexible slide wire cable 23, whereat it is affixed as by a pair of set screws 52, 52*a*.

A tubular ferrule 53 anchored to and extending somewhat outwardly of the flexible sheath 54 of the slide wire cable 23 has, at its outer end, a peripheral flange portion 55 by means of which said ferrule and its associated sheath is anchored in a conforming T-shape recess 56 provided at the inside near each end of the elongated housing structure 24.

The elongated housing structure 24 will also preferably be provided with a pair of symetrically-disposed, longitudinally-spaced through transverse openings 57, 57 for the passage of bolts for mounting the switching device 22 at a suitable location within the framework or body of the vehicle with which the device is to be used.

In use, the remote end of the flexible sheath 54 of the independent slide wire cable 23 will be anchored to the clutch lever side 58 of the power take-off gear box 12 as by a screwed-in-place anchor clamp 59. The control wire 52 extending outwardly of the independent slide wire cable 23, has its outer end pivotally linked to the outer end of an auxiliary lever arm 60 as by a cable connector device 61.

As illustrated in FIG. 7 the headed cable connector device 61 extends freely through a circular opening 62 in the auxiliary lever arm 60 and has a diametrically-extending opening 63 through which an end portion of the control wire 52 is secured as by a central jam screw 64.

The inner end of the auxiliary lever arm 60 is formed with a longitudinally-extending slot 65 for passage of a bolt 66 associated with the power take-off gear box 12 and normally utilized to retain the power take-off clutch lever 13 in place on its control shaft 67 (see FIG. 1).

A U-shaped guide and locating bar 68 beneath the head of the bolt 66 and straddling outer edge portions of the auxiliary lever arm 60 and the power take-off clutch lever 13, constrains said levers against relative angular movement. The slot 65 of the auxiliary lever arm 60 permits adjustment of its moment arm length with respect to the control shaft 67, thereby allowing for adjustment of the length of reciprocative travel of the slide bar 31 in its housing structure 24 upon actuation of the power take-off clutch lever 13 by use of the actuating knob 20 in the cab of the vehicle in which the device is installed. In this connection, with further reference to FIG. 6 it will be noted that the remote end of the sheath 69 of the lever control cable 21 is similiarly clamped in place by a screwed-in-place anchor clamp 59a and that the associated control wire 70 is pivotally connected with the outer end of the power take-off clutch lever 13 by means of a similar or idential cable connector device 61a.

In use of the operation cover, disposition of the control wire 70 will be such that when the power-take-off clutch 13 is in clutch-engaged position as illustrated in FIG. 1, the control wire 52 and its actuating knob 20 will be in fully withdrawn position with respect to the dashboard, and the slide bar 30 will be in its outer end limit position, as illustrated by the full line representation thereof in FIGS. 1 and 3. When the operator of the winch or hoist mechanism wishes to stop the operation of lifting or lowering a disabled vehicle, for example, he will push the acting knob 20 fully to the dashboard in which it is mounted, a distance of about 3 to 4 inches, causing sufficient turning of the power take-off clutch 13 in the clock-wise direction (as illustrated in FIG. 6) to disengage the power take-off transmission, with consequent termination of operation of the winch, independently of the direction of operation of the winch. In this connection it is to be noted that the direction of turning of the winch as used for raising or lowering a vehicle, for example, is determined by the setting of the engine transmission 17, that is, whether it is set to operate in the forward or reverse direction.

With reference to FIGS. 2 and 3, it will be seen that as the control wire 70 is thus actuated to disengage the power take-off mechanism, the control wire 52 comprising the auxiliary slide wire cable 23 will be drawn outwardly of its flexible sheath 54 to carry the slide bar 31 from the position illustrated by the full-line representation thereof in FIG. 3 to the position indicated by the broken-line representation thereof, during which travel, as is hereinabove described, said slide bar will have close-circuited the electrical switch comprising electrical contact members 32, 32 to temporarily close-circuit said switch.

As illustrated schematically in FIG. 1, the switch comprising contact members 32, 32 is series-connected with the electro-mechanical operation counter 50 through electrical conductors 72, 73 interconnecting the record vehicle battery 74 and said counter. Thus each time the switch comprising electrical contact members 32, 32 is close-circuited upon pulling out or pushing in of the control wire actuating knob 20, as described above, the counter 50 will receive an electrical energizing pulse operative to advance its counting mechanism by one unit. Since the electro-mechanical counter 50 is interconnected with the switch 32, 32 by a simple electrical conductor 72 and can be returned to chassis ground at nearly any location within the wrecker cab or within the engine compartment of the wrecker vehicle, for example, it can conveniently be placed at any position, whether readily observably or hidden from direct view, desired by the owner of the vehicle.

Since a towing job will normally involve four control cable operations, that is, winch lift start by pulling outwardly upon the actuating knob 20 for raising a vehicle, raised vehicle stop by next pushing the actuating knob in again, then winch lowering by again pulling outwardly upon the actuating knob, and then winch lowering stop upon finally pushing the control knob in again, a single towing job from pick-up to release of a towed vehicle will register four counts on the electro-mechanical counter 50. If, however, it is desired to record only one unit on the counter for each towing job, that is, for completion of all of the four operational steps of a completed towing job, the counter 50 could be of such design as to record one unit for each group of four impulses received by actuation of the electrical switching device 21.

While I have illustrated and described herein only one form in which my invention can conveniently be embodied in practice, it is to be understood that this form is presented by way of example only and not in limiting sense. The invention, in brief, comprises all the embodiments and modifications coming within the scope and spirit of the following claims.

What I claim as new and desire to secure by Letters Patent is:

1. A mechanical operation counter for use in association with a cable-controlled, lever-actuated power take-off clutch for controlling the operation of a mechanical device, comprising, in combination, a slide wire cable having an outer sleeve member and a control wire coaxially slidable within said sleeve member, an elongated housing structure, a guidance slot in said housing structure and extending longitudinally thereof, a slide bar slidably received for end-to-end movement within said guidance slot, one end of said slide wire cable control wire extending through one end of said housing structure and being secured at an outer end portion thereof to said slide bar for back and forth movement in unison therewith and within said guidance slot, means for securing an outer end portion of said outer sleeve member of said slide wire cable to one end of said elongated housing member, normally open-circuit electrical switch means controlled by movement of said slide bar from one end to the other within said guidance slot for momentarily close-circuiting said switch means, an electrically actuated counter, an electrical energizing circuit, said electrical switch means being connected in series in said energizing circuit, and means for pivotally connecting the other end of said control wire of said slide wire cable to the lever of the lever actuated power take-off clutch.

2. A mechanical operation counter as defined in claim 1 wherein said elongated housing structure comprises a pair of molded, non-electrically conductive, identical half-housing members, each half-housing member being formed along one side with a longitudinally-extending recess, said guidance slot being defined by said recesses upon said half-housing members being assembled in face-to-face, interfitting relation, and means for securing said half housing members in face-to-face interfitting relation.

3. A mechanical operation counter as defined in claim 2 wherein said recesses of said half-housing members are of such configuration as to define said guidance slot in T-shape cross-sectional configuration.

4. A mechanical operation counter as defined in claim 3 wherein said normally open-circuit electrical switch means comprises a pair of laterally-disposed electrical switch contact members molded, one each, in said half-housing members and comprising laterally opposed contact surface portions flush with an inner wall portion of said guidance slot, said slide bar comprising a transversely-extending, metallic brush contact member adapted to bridgingly shunt said opposed contact surface portions as said slide bar is moved from one end to the other within said guidance slot.

5. A mechanical operation counter as defined in claim 4, including means resiliently pressing said transversely-extending metallic brush contact member against said inner wall portion of said guidance slot.

6. A mechanical operation counter as defined in claim 5, wherein said means for securing said outer end portion of said one end of said slide wire cable control wire to said slide bar comprises a longitudinally extending opening in said slide bar through which said one end of said control wire extends, and set screw means extending perpendicularly through said slide bar and operative to abuttingly engage said slide wire.

7. A mechanical operation counter as defined in claim 5, wherein said means for securing said outer end portion of said outer sleeve member of said slide wire cable to one end of said elongated housing member comprises a tubular ferrule affixed at said outer end of said sleeve member and being formed with a peripheral flange portion at its outer end, the ends of each of said identical half-housing members being formed with recesses defining, upon assembly, complemental T-shaped recesses operative to capture an outer end portion of said ferrule.

8. A mechanical operation counter as defined in claim 6, wherein said means for pivotally connecting the other end of said control wire of said slide wire cable to the lever of the lever actuated take-off clutch comprises an auxiliary arm, and means for connecting said auxiliary lever arm to said power take-off clutch lever so that it extends in the opposite direction with respect thereto.

9. A mechancial operation counter as defined in claim 8, wherein said auxiliary lever arm comprises a longitudinally-extending slot and wherein said means for connecting said auxiliary lever arm to said power take-off clutch lever comprises a U-shaped locating bar straddling said take-off clutch lever and said auxiliary lever arm and a bolt extending through said locating bar, said longitudinally-extending slot and an inner end portion of said power take-off clutch lever.

* * * * *